US007325411B2

(12) United States Patent
Bush

(10) Patent No.: US 7,325,411 B2
(45) Date of Patent: Feb. 5, 2008

(54) COMPRESSOR LOADING CONTROL

(75) Inventor: James W. Bush, Skaneateles, NY (US)

(73) Assignee: Carrier Corporation, Farmington, CT (US)

( * ) Notice: Subject to any disclaimer, the term of this patent is extended or adjusted under 35 U.S.C. 154(b) by 248 days.

(21) Appl. No.: 10/923,298

(22) Filed: Aug. 20, 2004

(65) Prior Publication Data

US 2006/0037336 A1 Feb. 23, 2006

(51) Int. Cl.
*F25B 5/00* (2006.01)
*F25B 41/00* (2006.01)
*F25B 41/04* (2006.01)

(52) U.S. Cl. ..... 62/197; 62/223; 62/513

(58) Field of Classification Search ..... 62/197, 62/217, 222, 513, 196.1, 196.4
See application file for complete search history.

(56) References Cited

U.S. PATENT DOCUMENTS

| | | | | |
|---|---|---|---|---|
| 4,180,986 | A * | 1/1980 | Shaw | 62/192 |
| 4,878,818 | A | 11/1989 | Shaw | |
| 4,938,029 | A | 7/1990 | Shaw | |
| 4,938,666 | A | 7/1990 | DeSantis et al. | |
| 5,996,364 | A | 12/1999 | Lifson et al. | |
| 6,047,556 | A | 4/2000 | Lifson | |
| 6,279,331 | B1 * | 8/2001 | Hirota | 62/117 |

FOREIGN PATENT DOCUMENTS

JP 11182946 A * 7/1999

* cited by examiner

*Primary Examiner*—Chen Wen Jiang
(74) *Attorney, Agent, or Firm*—Bachman & LaPointe, P.C.

(57) ABSTRACT

A system has a number of parallel flowpath segments between a compressor and an evaporator. One or more valves selectively block and unblock at least one of the segments to provide capacity control.

21 Claims, 2 Drawing Sheets

COMPRESSOR LOADING CONTROL

BACKGROUND OF THE INVENTION (1) Field of the Invention

The invention relates to compressors. More particularly, the invention relates to compressor unloading in air conditioning or refrigeration systems.

(2) Description of the Related Art

In a closed air conditioning or refrigeration system there are a number of methods of unloading that can be employed. Commonly assigned U.S. Pat. No. 4,938,666 discloses unloading one cylinder of a bank by gas bypass and unloading an entire bank by suction cutoff. Commonly assigned U.S. Pat. No. 4,938,029 discloses the unloading of an entire stage of a compressor and the use of an economizer. Commonly assigned U.S. Pat. No. 4,878,818 discloses the use of a valved common port to provide communication with suction for unloading or with discharge for $V_i$ control, where $V_i$ is the discharge pressure to suction pressure ratio. In employing these various methods, the valve structure is normally fully open, fully closed, or the degree of valve opening is modulated so as to remain at a certain fixed position. Commonly assigned U.S. Pat. No. 6,047,556 (the '556 patent, the disclosure of which is incorporated by reference herein as if set forth at length) discloses the use of solenoid valve(s) rapidly cycling between fully open and fully closed positions to provide capacity control. The cycling solenoid valve(s) can be located in the compressor suction line, the compressor economizer line and/or the compressor bypass line which connects the economizer line to the suction line. The percentage of time that a valve is open determines the degree of modulation being achieved.

Nevertheless there remains room for further improvement in the art.

SUMMARY OF THE INVENTION

One aspect of the invention involves an apparatus having a compressor and an evaporator. The compressor has suction and discharge ports. A number of parallel return flowpath segments run between the compressor suction port and evaporator. One or more valves selectively block and unblock at least one of the segments.

In various implementations, at least a first of the one or more valves may be a solenoid valve. At least a first of the one or more valves may be modulated with a duty cycle and frequency. A controller may be coupled to the first valve and may be programmed to control at least one of said duty cycle and frequency. The one or more valves may be bistatic. A first of the segments may lack such a valve. A condenser may be coupled between the compressor discharge port and evaporator. A control system may be coupled to the one or more valves and may be programmed to operate the one or more valves to provide a modulated capacity control. There may be at least a first and a second of the flowpath segments having different respective first and second effective cross-sectional areas. There may be at least a first and a second of the flowpath segments having the same respective first and second effective cross sectional areas.

Another aspect of the invention involves a method for operating such an apparatus. At least one operational parameter is detected. Responsive to the detecting, at least one modulation parameter is determined for at least a first of the one or more valves.

In various implementations, the at least one operational parameter may be at least one of: saturated evaporating temperature; saturated evaporating pressure; air temperature entering or leaving the evaporator coil; saturated condensing temperature; saturated condensing pressure; air temperature entering or leaving the condenser; compressor current; compressor voltage; and compressor power. The determining may include determining an identity for the first valve from a number of valves.

Another aspect of the invention involves a system having a compressor, a condenser, an expansion device, and an evaporator. A discharge line couples the compressor to the condenser to carry refrigerant from the compressor to the condenser. A suction line couples the evaporator to the compressor to carry refrigerant from the evaporator to the compressor. The suction line has first and second parallel segments. An electrically actuated valve is in the first segment. There are means for rapidly pulsing the electrically actuated valve in the first segment whereby the rate of flow in the suction line to the compressor is modulated. A fluid path extends from a point intermediate the condenser and the expansion device to the compressor at a location corresponding to an intermediate point of compression in the compressor. A bypass line is connected to the fluid path and the suction line. An electrically actuated valve is in the bypass line. There are means for rapidly pulsing the electrically actuated valve in the bypass line whereby the rate of flow of bypass to the suction line is modulated. An economizer circuit is connected to the fluid path. An electrically actuated valve is in the economizer circuit. There are means for rapidly pulsing the electrically actuated valve in the economizer circuit whereby the rate of economizer flow to the compressor is modulated.

In various implementations, the suction line may include a third segment in parallel with the first and second segments. The electrically actuated valve in the first segment may be a first solenoid valve and the system may include a second solenoid valve in the second segment.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
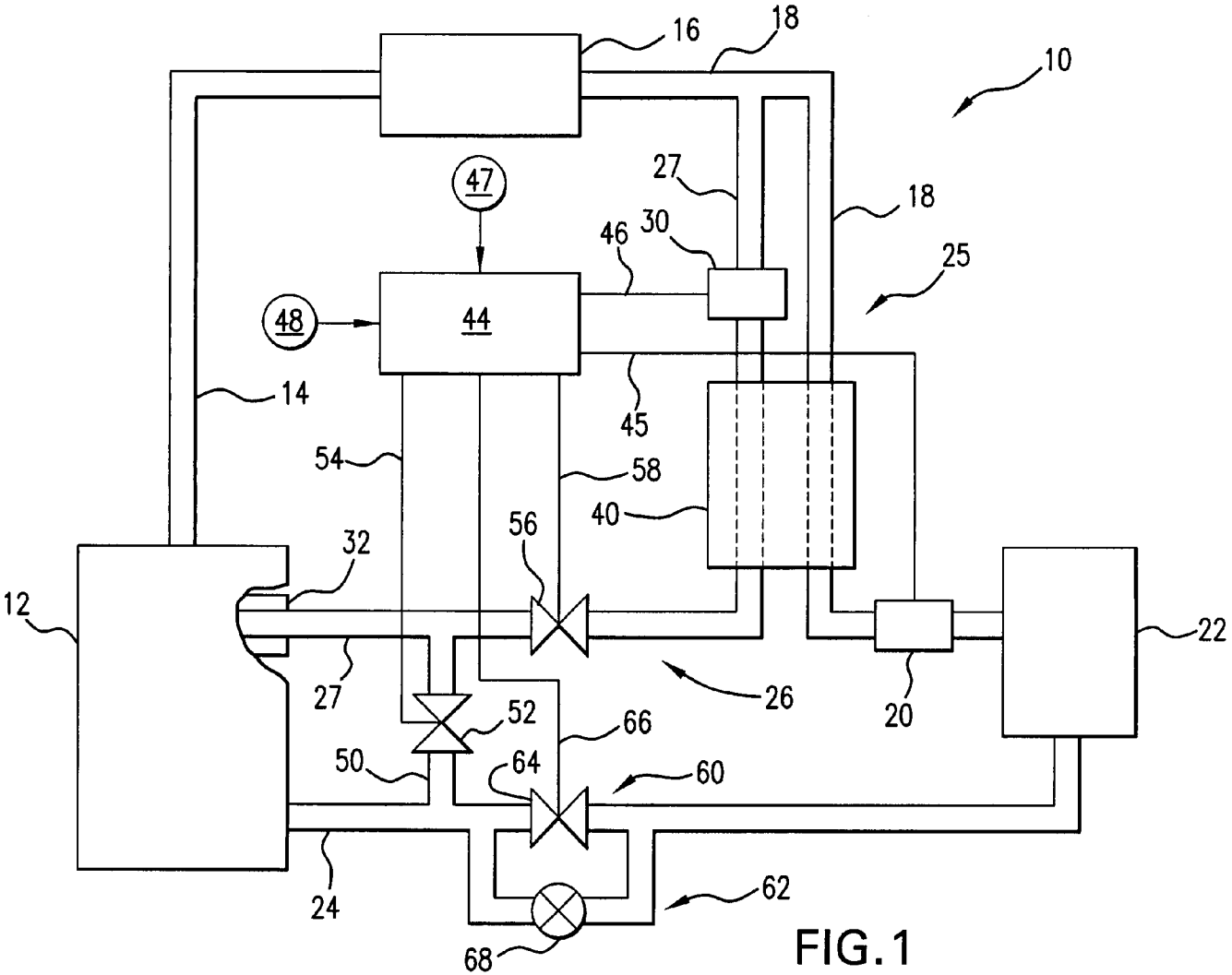
FIG. 1 is a schematic representation of an economized refrigeration or air conditioning system employing the present invention.

FIG. 1, shows an exemplary closed refrigeration or air conditioning system 10 based upon that of the '556 patent. The system has a hermetic compressor 12, from which a compressor discharge line 14 extends downstream to a condenser 16. An intermediate line 18 extends downstream from the condenser to an expansion device 20 and an evaporator 22. A suction line 24 extends downstream from the evaporator to the compressor to complete the main circuit/flowpath 25.

To form a bypass economizer circuit/flowpath 26, a line 27 branches off from line 18 and contains an expansion device 30 and connects with the compressor 12 via a port 32 at a location corresponding to an intermediate point in the compression process. An economizer heat exchanger 40 is located such that the line 27, downstream of the expansion device 30, and the line 18, upstream of the expansion device 20, are in heat exchange relationship. Exemplary expansion devices 20 and 30 are electronic expansion devices (EEV) and are illustrated as coupled to a control/system 44 (e.g., a microprocessor-based controller) for receiving control inputs via control lines 45 and 46, respectively. The exemplary control system 44 may receive inputs such as zone inputs from one or more sensors 47 and external control inputs from one or more input devices (e.g., thermostats 48). A bypass line 50 connects the lines 27 and 24 downstream of the economizer heat exchanger 40 and the evaporator 22, respectively. A solenoid valve 52 is located in the line 50 and coupled to the control system 44 via a control line 54. A solenoid valve 56 in the line 27 is coupled to the control system 44 via a control line 58.

Although an EEV 20 is discussed, any of a variety of expansion devices may be used (e.g., a thermal expansion valve (TXV), fixed orifice, or capillary tube). Although solenoid valves are discussed, other electrically actuated valves may be used. Yet other valves (e.g., pressure-actuated valves piloted by electrically actuated valves) are possible.

In the exemplary embodiment, a portion of the suction line 24 is bifurcated downstream of the evaporator 22 and upstream of the intersection with the line 50 to form a pair of parallel flowpath segments 60 and 62. In the exemplary embodiment, a solenoid valve 64 is located in the first segment 60 and is coupled to the control system 44 by a control line 66. A fixed restrictor 68 is located in the second segment 62. Such a restrictor may be appropriate, for example, where the characteristic cross-section of the tubing utilized is in excess of that providing a desired effective cross-sectional area for the associated flowpath segment. The restrictor, accordingly, provides the desired effective area.

In normal, non-economized, operation of the system 10, the valves 52 and 56 are closed and hot high pressure refrigerant gas from the compressor 12 is supplied via the line 14 to the condenser 16 where the refrigerant gas condenses to a liquid. The liquid is supplied via the line 18 and the idle economizer heat exchanger 40 to the EEV 20. The EEV 20 causes a pressure drop and partial flashing of the liquid refrigerant passing therethrough. The liquid-vapor mixture of refrigerant is supplied to the evaporator where the liquid refrigerant evaporates to cool the required space and the resultant gaseous refrigerant is supplied to the compressor via the suction line 24 to complete the main cycle.

The operation described above is conventional and the cooling capacity of the system could be conventionally controlled by turning the compressor on and off, normally in response to inputs from a thermostat or other control device. Pursuant to the teachings of the present invention, the solenoid valve 64 may be rapidly pulsed between open and closed conditions to control the capacity of the compressor 12. Modulation is achieved by controlling the percentage of the time that the valve 64 is open and closed.

In an exemplary implementation, the valve 56 is a normally closed valve (i.e., when not energized it is closed and when energized it is open) for safety. If the valve 56 was normally open, during a compressor off cycle there would be the possibility of liquid refrigerant migrating back to the compressor through the economizer line which could contribute to a potentially damaging flooded start of the compressor. Having the valve 56 closed when de-energized helps prevent this. Also, if the valve 56 were to fail, it would fail with the economizer circuit off which results in reduced system capacity and efficiency but avoids other potentially damaging problems with compressor power draw or liquid migration during certain operating conditions. In an exemplary implementation, the valve 64 is a normally open valve for safety. If valve 64 fails open, then the system will still perform and system capacity will ultimately be controlled by cycling the compressor. If valve 64 failed closed, then the system would fail to provide any significant cooling at all.

Operation of the valve 64 may be approximated as a square wave with the fraction of time open defining a duty cycle and the frequency of opening/closing defining a cycle frequency. Inertia and other factors influencing valve response time may tend to smooth the wave form somewhat. In the closed condition, the valve 64 completely blocks flow through the first segment 60. The restriction in the second segment 62 is effective to the limit capacity of the system to a desired minimum amount (e.g., in the 1-30% range). For example, 1% may be high enough to prevent corona discharge in scroll compressors. 30% might be a reasonable upper limit for the lowest level of capacity modulation in a system. With the valve 64 open, the first segment 60, or a combination of the first and second segments 60 and 62, is effective to provide a desired maximum capacity (e.g., 100%). Duty cycle modulation of the valve 64 is effective to provide a continuum of capacity control between the two values. In an exemplary embodiment, the minimum may be a very small amount (e.g., 1-2%), functioning merely to prevent damage associated with hard vacuum during transient intervals wherein the valve 64 is closed or in the event of a failure in the closed condition. This allows full modulation in the range thereabove (e.g., 2-100%). As noted above, if operation in the lower portion of that range is not required, the minimum may be higher.

The cycling of valves 52, 56 and 64, individually, allows for various forms of capacity control with the amount of time a particular valve is open relative to the time that it is closed determining the degree of modulation of capacity. The frequency of modulation for typical systems can range from 0.1 to 100 seconds.

To increase capacity of the system, the economizer heat exchanger 40 is employed. In full economized operation, valve 56 is open, valve 52 is closed, and valve 64 is open. The suction line 24 is fully open, as is economizer line 27. Both lines are carrying the maximum possible mass flow to the compressor. This results in the maximum possible heat capacity in the evaporator. A portion of the liquid refrigerant in exiting the condenser 16 into the line 18 is directed into the line 27 where the EEV 30 causes a pressure drop and a partial flashing of the liquid refrigerant. The low pressure liquid refrigerant passes into the economizer heat exchanger where the refrigerant in the line 27 extracts heat from the refrigerant in the line 18 causing the latter to cool further and thereby provide an increased cooling effect in the evaporator. The refrigerant in the line 27 passing through the economizer heat exchanger is supplied to the compressor 12 via the port 32 under the control of the valve 56 which is, in turn, controlled by the control system 44. The line 27 delivers refrigerant gas to a trapped volume (not shown) at an intermediate stage of compression in the compressor.

In the normal or non-economized operation, valve 56 is closed, valve 52 is closed, and valve 64 is open. The economizer circuit is closed and does not provide additional cooling to the liquid refrigerant upstream of the EEV 20. This results in a loss of capacity in evaporator 22 even though the mass flow through the evaporator 22 will remain about the same due to the fully open suction line 24. Depending somewhat on operating conditions, the system may configured so that basic economized capacity may be 110-200% or more of basic non-economized capacity. The lower might be associated with at air conditioning-like applications, intermediate values with heat pump applications, and the higher values with refrigeration applications.

To lower the capacity of the system, the bypass line solenoid valve 52 is employed. In a bypass mode operation valve 56 is closed, valve 52 is open, and valve 64 is open. Some of the refrigerant entering the compressor through suction line 24 exits the compressor through port 32 and returns to the suction line 24 via line 50 and the proximal portion of line 27. This flow displaces some of the refrigerant flow in the suction line 24 from the evaporator. Thus the mass flow through, and the heat capacity of, the evaporator is reduced. This reduced capacity may be an exemplary 50-70% (or in some cases higher) of the normal capacity.

In a suction cutoff operation, valve 56 is closed, valve 52 is open, and valve 64 is closed. Capacity is reduced to a minimum as defined by restrictor 68. This may be slightly below the normal, non-economized mode minimum.

Modulation of any of the three valves 52, 56, and 64 may be done individually and within one of the first three modes of operation (economized, normal, and bypass). In a basic implementation, only one valve would be modulated at a time and only within one of the three modes. Specifically, valve 56 would be modulated in the economized operation for the capacity range from the unmodulated economized down to the unmodulated normal operation. The economizer flow in the line 27 and, as such, system capacity is controlled by rapidly cycling the valve 56 to modulate the amount of economizer flow to the intermediate stage of compression in the compressor.

Valve 52 would be modulated in normal operation for the capacity range from the unmodulated normal down to the unmodulated bypass operation. In this arrangement, the valve 56 is closed, and gas at intermediate pressure is bypassed from the compressor via the port 32, the line 27, and the line 50 into the suction line 24. The amount of bypassed gas and, as such, the system capacity is varied by rapidly cycling the valve 52. Thus the port 32 is used as both an economizer port and a bypass or unloading port.

Valve 64 would be modulated in bypass operation for the capacity range from the unmodulated bypass operation down to the unmodulated suction cutoff operation.

Figure 2:
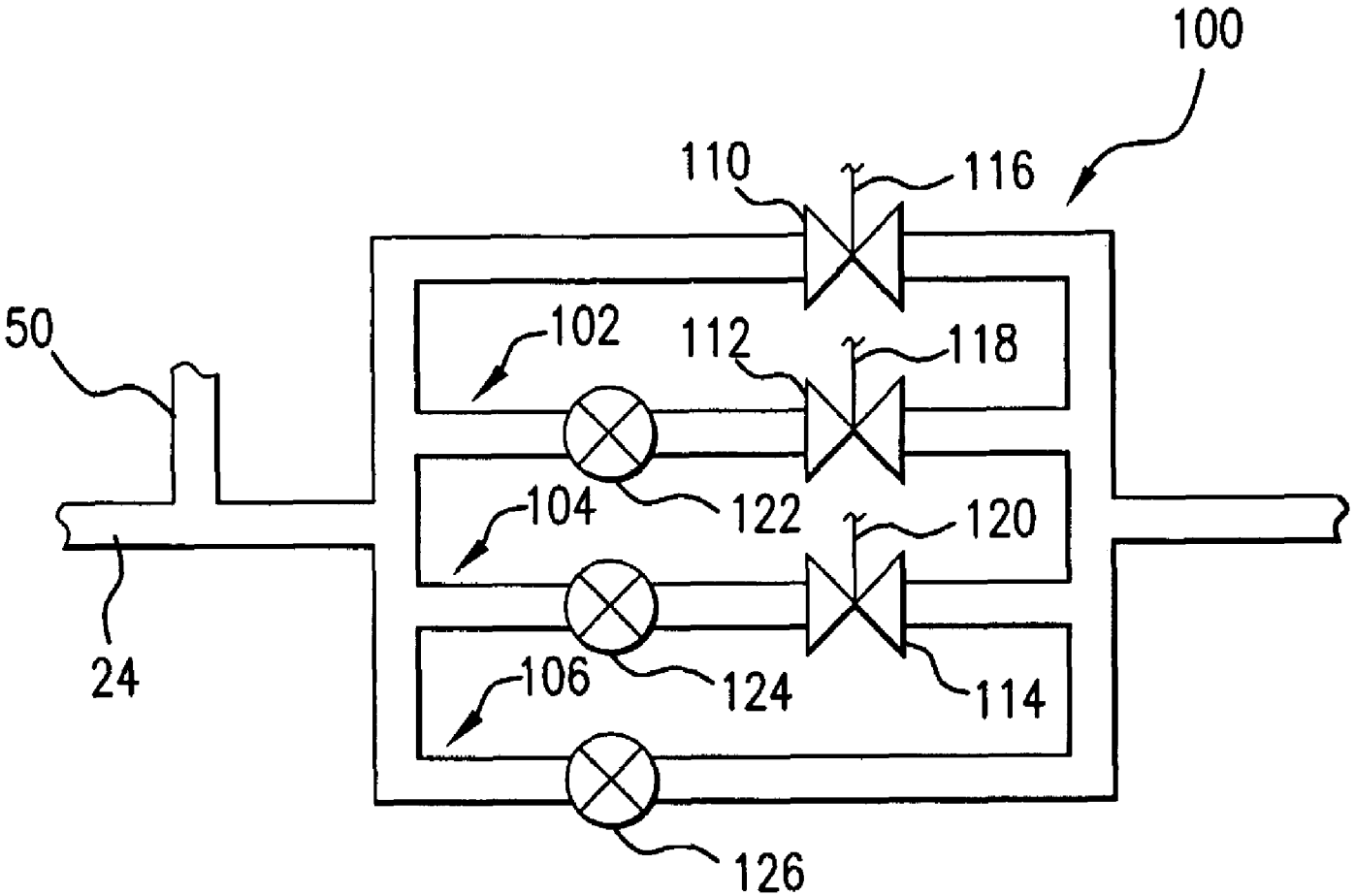
FIG. 2 is a partial schematic view of an alternate suction line for the system of FIG. 1.

Many variations on the parallel structure are possible. FIG. 2 shows an alternative set of segments 100, 102, 104, and 106 in the line 24. In the exemplary embodiment, the segments 100, 102, and 104 have respective solenoid valves 110, 112, and 114 with respective control lines 116, 118, and 120 coupling the valves to the control system 44. In the exemplary embodiment, the segments 102, 104, and 106, have respective restrictors 122, 124, and 126. In the exemplary embodiment, the first segment 100 has sufficient effective cross-section to provide 100% capacity regardless of the condition of the other segments. Alternatively, however, it may be smaller. In the exemplary embodiment, the remaining segments lack such cross-section both individually and in combination. The size of the restrictors may be chosen to facilitate particular operational sequences which may depend, at least in part, on anticipated operating conditions (e.g., how much time the compressor is expected to operate in various locations along the capacity spectrum, desired transitions between such conditions, and the like). In an exemplary implementation, the flowpath 106 is a mere residual flowpath with very low capacity merely to protect the compressor. In the exemplary implementation, the restrictors 122 and 124 are sized so that with the first (main) valve 110 closed: (1) with the second and third valves 112 and 114 open, the combined segments 102 and 104 provide the system with ⅔ capacity; and (2) with the valve 112 closed and the valve 114 open the segment 104 provides the system with ⅓ capacity. To achieve this capacity balance, the sizes of the restrictors 122 and 124 may need to differ due to the effects of varying pressure. Relative restriction sizing may be achieved via theoretical calculations or experimental iteration to achieve a desired capacity distribution. In an exemplary operation, modulation between full and ⅔ capacity may be achieved exclusively by modulating the main valve 110 with the second and third valves 112 and 114 open. Because the compressor only falls to ⅔ capacity when the main valve is closed, the system responds more slowly than if all capacity were shut off. Thus, the main valve may be cycled more slowly. The slower cycling itself may extend life and improve reliability. Additionally, by not requiring faster cycling, a more robust valve may be used relative to a situation wherein closing of the main valve reduces capacity to essentially zero. In a second operational zone between ⅓ and ⅔ capacity, the main valve 110 may be closed, the third valve 114 open, and the second valve 112 modulated. In this zone, the bypassing flow through the third segment 104 limits required cycling speed and, therefore, contributes to the life of the second valve 112 as bypass through the second and third segments 102 and 104 contributed to the life of the main valve 110 during operation in the first zone. In a third zone between the minimum and ⅓ capacity, the main and second valves are both closed and the third valve 114 is cycled.

In general, a first set of measurements or inputs of parameters are needed to determine the desired system capacity. This in turn is used to determine which operational state is desired (e.g., which of valves 110, 112, and 114 are to be open or closed or active/modulated). A second set of parameters will then be needed to monitor the actual system state and to control the cycling of the active valve. The second set of parameters may overlap or even be coincident with the first. For example, an input from a thermostat may determine that a system capacity in a certain range is needed. This input may include not only the temperature of a conditioned space relative to a setpoint (which is the "traditional" thermostat role) but may also include information about how rapidly the temperature (and possibly humidity) of the conditioned space is responding with the system operating in a certain capacity range. In an exemplary situation, on a hot day a homeowner comes home to a warm house and turns on the air conditioning system. The spread between house temperature and thermostat setting is large and the system will operate at maximum capacity—all valves open—with the objective to quickly cool down the house. As the system operates the house temperature comes down and approaches the thermostat setpoint. As it does so, the controller closes valve 110 and continues to operate the system at ⅔ capacity. If the temperature begins to rise again to a higher setpoint the controller opens valve 110 to again lower the temperature and the system cycles between full and ⅔ capacity to maintain indoor temperature in the desired range. In an exemplary situation, the valve 110 will cycle rather slowly with one complete on/off cycle covering several minutes up to a sizeable portion of an hour or more depending on load matching—that is the balance between the heat load (e.g., on the house being cooled) and the cooling capacity of the system. With sufficient parallel branches (the FIG. 2 embodiment may have enough) there may be no need for rapid cycling of the valve in some systems. With sufficient parallel branches the capacity increments achieved by opening or closing one valve (i.e., one branch) at a time may be sufficiently close to each other that the system responds very slowly to the relatively small change in capacity.

If the temperature continues to fall with the system at ⅔ capacity, the controller then closes valve 112 and operates the system at ⅓ capacity. If this is insufficient to maintain the house at the setpoint the controller will cycle valve 112 in a similar manner as valve 110 in the earlier case. This may be similar to conventional thermostat operation except that the temperature swings will not be as rapid because the system is running all the time at some capacity closer to what is needed. The system will also be operating at a higher cycle efficiency due to the reduced capacity. A conventional thermostat normally has two temperature limits: a lower limit at which the system shuts off; and a higher limit at which it comes on. The variable capacity operation will need additional setpoints (e.g., one above the normal higher limit and one below the normal lower limit). These extra limits will be used to signal the controller to switch between the 0 to ⅓, ⅓ to ⅔, and ⅔ to full capacity ranges.

Use of a more intelligent controller may provide further operational features. The controller may estimate, based on the rate of temperature change as the system approaches setpoint or even goes through a modulation cycle or two, that a capacity of approximately 80% of fill capacity is needed. In this case, it will operate valve 110 with a duty cycle that approximates 80% of system capacity. As the controller continues to monitor the rate of temperature change or stability in the house, it may further refine the estimate and associated duty cycle (e.g., to 75% of system capacity and so on). Later in the day as the outside temperature cools off, the required system capacity may fall below ⅔ and the controller may switch to operation in the middle mode.

With the basic controller, operation with valve 110 closed 100% of the time will simply result in continued cooling down of the house. As the temperature falls below the second setpoint which is a little a little lower than the first, the controller will close valve 114 in addition to valves 112 and 110 and begin cycling valve 114 as the house temperature rises and falls within the limits of the thermostat setpoints. The more intelligent controller may compute an estimated capacity need and corresponding duty cycle as well as maintain a tighter control over the setpoints to minimize temperature variations in the house. In this case so far the only active input to either controller is the temperature of the conditioned space—thermostat setpoints are a passive input (a fixed reference). The controller cycles system capacity or varies the valve duty cycle in response to small variations in the indoor temperature. In this case the first and second set of measurements are the same—the indoor temperature.

A yet more sophisticated system may include inputs of outdoor temperature to generate a better estimate of desired system capacity in advance of stabilized cycling and to forecast changes of cycling rates and valve closure combinations prior to actual indoor temperature swings. It may also include pressure or temperature measurements in the system evaporator and/or condenser to determine actual system capacity at the moment to more quickly set and control to the correct capacity and to forecast needed adjustments in advance of any actual indoor temperature swing. In this case the first set of inputs would be the indoor and outdoor temperature measurements and the second set would be the indoor temperature measurement and the system pressures and/or temperatures.

In at least some of these modes of operation, the required frequency of modulation may be quite long. If the criterion for opening and closing a valve is a direct variation in indoor temperature, as described for the simpler controller cases, the thermal inertia of the cooled space—the house—may result in many minutes or more of operation with one or another valve combination before temperature changes enough to drive a change in valve open/close states. Also note that as more valves are added to the system and more system capacity increments become available, the required frequency of modulation decreases. This could be much longer than the exemplary 100 seconds identified above. The fastest frequency of modulation would be for the simplest case of FIG. 1 where only valve 64 is modulated in the suction line.

In alternative implementations, more complicated control is possible wherein, dynamic factors may influence which valve or combination are modulated at any given capacity. For example, the sizing of the restrictions may be such that operation at 60% capacity could be achieved alternatively: by only modulating the main valve; or by modulating one of the other valves with the main valve closed. During brief excursions downward from higher capacities (e.g., in the 70% plus range) modulation of the first valve only may be continued to avoid use of the second valve.

One or more embodiments of the present invention have been described. Nevertheless, it will be understood that various modifications may be made without departing from the spirit and scope of the invention. For example, when implemented as a modification or a reengineering of an existing system, details of the existing system may heavily influence details of the implementation. Accordingly, other embodiments are within the scope of the following claims.

What is claimed is:

1. An apparatus comprising:

a compressor having suction and discharge ports;

an evaporator;

a plurality of parallel return flowpath segments between the compressor suction port and evaporator;

one or more valves for selectively blocking and unblocking at least one of the segments, a first of the segments lacking such a valve; and a controller coupled to a first valve of the one or more valves and programmed to control at least one of a duty cycle and a frequency of a modulation of the first valve.

2. The apparatus of claim 1 wherein:

the one or more valves are bistatic.

3. The apparatus of claim 1 further comprising:

a condenser coupled between the compressor discharge port and evaporator.

4. The apparatus of claim 1 wherein:

there are at least a first and a second of the flowpath segments having different respective first and second effective cross-sectional areas.

5. The apparatus of claim 1 wherein:

there are at least a first and a second of the flowpath segments having the same respective first and second effective cross-sectional areas.

6. A method for operating the apparatus of claim 1 comprising:

detecting at least one operational parameter; and responsive to the detecting, determining at least one modulation parameter for at least said first of the one or more valves.

7. The method of claim 6 wherein:

the at least one operational parameter is at least one of:

saturated evaporating temperature;

saturated evaporating pressure;

air temperature entering or leaving the evaporator coil;

saturated condensing temperature;

saturated condensing pressure;

air temperature entering or leaving the condenser;

compressor current;

compressor voltage; and compressor power; and the determining includes:

determining an identity for the first valve from a plurality of valves.

8. The apparatus of claim 1 wherein:

at least a first of the one or more valves is a solenoid valve.

9. A system comprising:

a compressor;

a condenser;

a discharge line, coupling the compressor to the condenser to carry refrigerant from the compressor to the condenser;

an expansion device;

an evaporator;

a suction line, coupling the evaporator to the compressor to carry refrigerant from the evaporator to the compressor and comprising a first and second parallel segments;

an electrically actuated valve in the first segment;

means for rapidly pulsing said electrically actuated valve in the first segment whereby the rate of flow in said suction line to said compressor is modulated;

a fluid pat extending from a point intermediate said condenser and said expansion device to said compressor at a location corresponding to an intermediate point of compression in said compressor;

a bypass line connected to said fluid path and said suction line;

an electrically actuated valve in said bypass line;

means for rapidly pulsing said electrically actuated valve in said bypass line whereby the rate of flow of bypass to said suction line is modulated;

an economizer circuit connected to said fluid path;

an electrically actuated valve in said economizer circuit; and means for rapidly pulsing said electrically actuated valve in said economizer circuit whereby the rate of economizer flow to said compressor is modulated.

10. The system of claim 9 wherein:

the suction line includes a third segment in parallel with the first and second segments; and the electrically actuated valve in the first segment is a first solenoid valve and the system includes a second solenoid valve in the second segment.

11. A method for operating an apparatus, the apparatus comprising:

a compressor having suction and discharge ports;

an evaporator;

a plurality of parallel return flowpath segments between the compressor suction port and evaporator; and one or more valves for selectively blocking and unblocking at least one of the segments, wherein the method comprises:

operating the compressor to drive a refrigerant flow through the evaporator;

detecting at least one operational parameter; and responsive to the detecting, determining at least one modulation parameter for at least a first of the one or more valves;

modulating said at least first of the one or more valves across a full range of normal operation to restrict a portion of the flow along the associated segment;

not modulating a restriction on at least one of the segments across said full range of normal operation.

12. The method of claim 11 wherein:

the at least one operational parameter is at least one of:

saturated evaporating temperature;

saturated evaporating pressure;

air temperature entering or leaving the evaporator coil;

saturated condensing temperature;

saturated condensing pressure;

air temperature entering or leaving the condenser;

compressor current;

compressor voltage; and compressor power; and the determining includes:

determining an identity for the first valve from a plurality of valves.

13. An apparatus comprising:

a compressor having suction and discharge ports;

an evaporator;

a plurality of parallel return flowpath segments between the compressor suction port and evaporator; and one or more valves for selectively blocking and unblocking at least one of the segments; and a control system coupled to the one or more valves and configured to modulate said one or more valves across a full range of normal operation while not modulating a restriction along a first of the segments.

14. An apparatus comprising:

a compressor having suction and discharge ports;

an evaporator;

a plurality of parallel return flowpath segments between the compressor suction port and evaporator;

one or more valves for selectively blocking and unblocking at least one of the segments, a first of the segments lacking such a valve; and a control system coupled to the one or more valves and programmed to operate the one or more valves to provide a modulated capacity control.

15. The apparatus of claim 14 wherein:

at least a first of the one or more valves is a solenoid valve.

16. The apparatus of claim 14 wherein;

the one or more valves are bistatic.

17. The apparatus of claim 14 further comprising:

a condenser coupled between the compressor discharge port and evaporator.

18. The apparatus of claim 14 wherein:

there are at least a first and a second of the flowpath segments having different respective first and second effective cross-sectional areas.

19. The apparatus of claim 14 wherein:

there are at least a first and a second of the flowpath segments having the same respective first and second effective cross-sectional areas.

20. A method for operating the apparatus of claim 14 comprising:

detecting at least one operational parameter; and responsive to the detecting, determining at least one modulation parameter for at least said first of the one or more valves.

21. The method of claim 20 wherein:

the at least one operational parameter is at least one of:

saturated evaporating temperature;

saturated evaporating pressure;

air temperature entering or leaving the evaporator coil;

saturated condensing temperature;

saturated condensing pressure;

air temperature entering or leaving the condenser;

compressor current;

compressor voltage; and compressor power; and the determining includes:

determining an identity for the first valve from a plurality of valves.

* * * * *

UNITED STATES PATENT AND TRADEMARK OFFICE

CERTIFICATE OF CORRECTION

PATENT NO. : 7,325,411 B2
APPLICATION NO. : 10/923298
DATED : February 5, 2008
INVENTOR(S) : James W. Bush It is certified that error appears in the above-identified patent and that said Letters Patent is hereby corrected as shown below:

In column 9, claim 9, line 21, “pat” should read --path--.

In column 10, claim 16, line 32, after “wherein” delete the “;” and insert a --:--.

Signed and Sealed this

Eighth Day of July, 2008

JON W. DUDAS
*Director of the United States Patent and Trademark Office*